US006106311A

United States Patent [19]

Hughes

[11] Patent Number: 6,106,311

[45] Date of Patent: Aug. 22, 2000

[54] ELECTRICAL CONNECTOR INCLUDING SPRING MECHANISM FOR COVERING LEADS IN OPEN POSITION

[75] Inventor: Jeffrey P. Hughes, Lawrenceville, Ga.

[73] Assignee: Scientific-Atlanta, Inc., Norcross, Ga.

[21] Appl. No.: 09/289,029

[22] Filed: Apr. 9, 1999

[51] Int. Cl.[7] ..... H01R 13/44

[52] U.S. Cl. ..... 439/141

[58] Field of Search ..... 439/729, 728, 439/140, 141

[56] References Cited

U.S. PATENT DOCUMENTS

| | | | |
|---|---|---|---|
| 2,444,843 | 7/1948 | Modrey | 439/140 |
| 3,575,684 | 4/1971 | McIntyre | 439/140 |
| 4,959,609 | 9/1990 | Prokopp et al. | 439/140 |
| 4,969,834 | 11/1990 | Johnson | 439/141 |
| 5,226,827 | 7/1993 | Corcoles et al. | 439/140 |
| 5,334,032 | 8/1994 | Myers et al. | 439/140 |
| 5,997,320 | 12/1999 | DeMello | 439/148 |
| 6,022,224 | 2/2000 | Peters | 439/66 |

*Primary Examiner*—Neil Abrams
*Assistant Examiner*—Hae Moon Hyeon
*Attorney, Agent, or Firm*—Kelly A. Gardner; Kenneth M. Massaroni; Hubert J. Barnhardt, III

[57] ABSTRACT

A connector (100) includes at least one electrical lead for electrically coupling a first device (100) to a second device (210), a base (110) through which the electrical lead (105) extends, and an upper portion (150) through which the electrical lead (105) also extends. A spring mechanism (135) mechanically couples the base (110) and the upper portion (150) and holds the base (110) away from the upper portion (150), and the upper portion (150) includes an upper guide (145) having a hole formed therein. When the connector (100) is in an open position (in which the connector (100) is electrically inactive), the electrical lead (105) does not extend through the hole in the upper guide (150). When the connector (100) is in a closed position (in which the connector (100) is electrically active), the electrical lead (105) extends through the hole in the upper guide (145).

10 Claims, 5 Drawing Sheets

ELECTRICAL CONNECTOR INCLUDING SPRING MECHANISM FOR COVERING LEADS IN OPEN POSITION

FIELD OF THE INVENTION

This invention relates generally to electrical connectors and more specifically to electrical connectors having alignment and lead protection features.

BACKGROUND OF THE INVENTION

Electrical connectors are typically used to connect a first electrical device to a second electrical device. Most electrical connectors include one or more conductive leads that are connected at a first end to circuitry of the first device and that are connected at a second end to circuitry of the second device. An electrical connector may be as simple as a piece of wire that is soldered at both ends to the connected devices. Many connectors, however, also include electrically insulative mechanical components for performing various functions. A connector can, for instance, include features for mechanically securing the connector to one or both devices that are being coupled, spacers to hold one device in place with respect to the other device, or features, such as handles or gripping surfaces, that aid in assembling the connector to the devices that are to be connected.

The use of conventional connectors can cause several problems. A first problem is that many connectors, especially those with a number of electrical leads, can be misaligned so that the electrical leads contact unintended areas of the electrical devices in which the connectors are mounted. In such a case, even if the misaligned connector is not physically damaged, improper electrical operation can occur.

An associated problem is connector or device malfunctions resulting from connector breakage. Many electrical devices that use connectors have limited space available on printed circuit boards or other substrates included in the devices, and minimal surface area is available for placement of connector leads. Consequently, smaller, and usually more delicate and fragile, connector leads are used, and these are more easily broken by rough handling, connector misalignment, or even routine use over time.

Thus, what is needed is a connector that is less likely to be electrically misaligned and that resists breakage.

DETAILED DESCRIPTION OF A PREFERRED EMBODIMENT OF THE INVENTION

Figure 1:
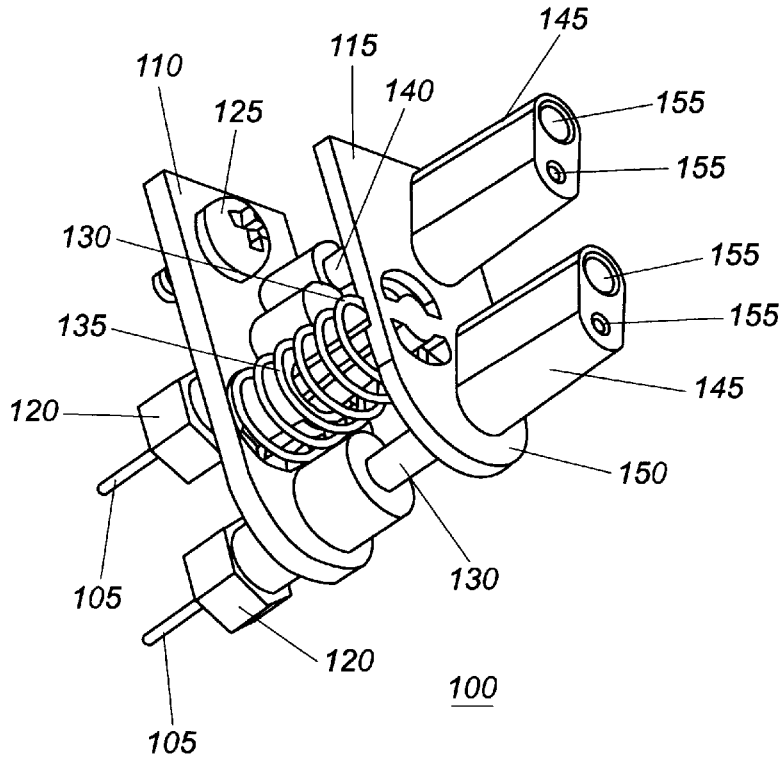
FIGS. 1 and 2 are perspective views of an electrical connector in a first position according to the present invention.
Figure 2:
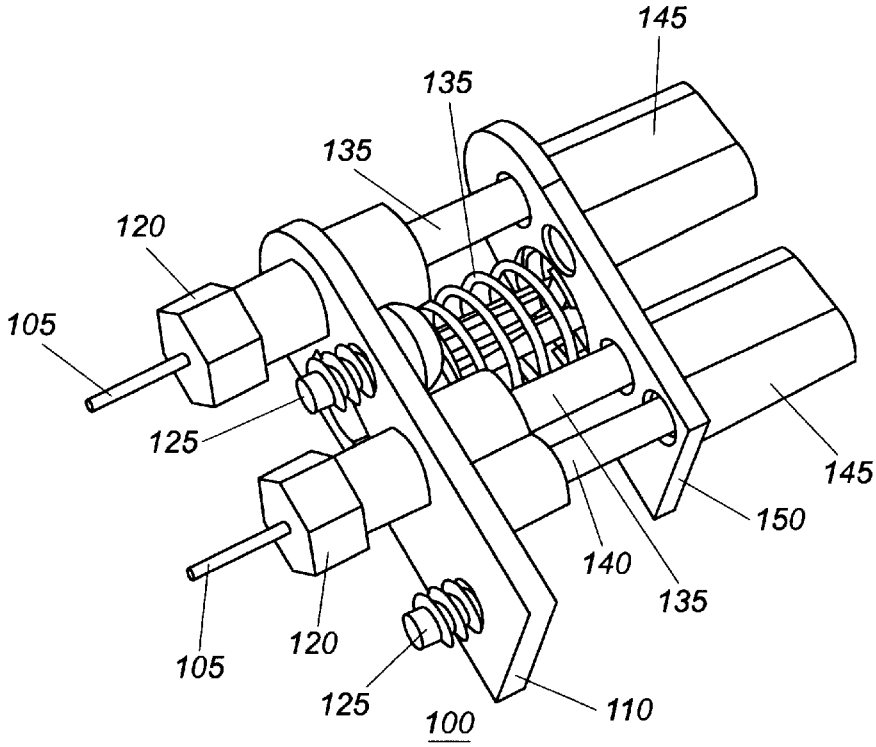

Referring to FIGS. 1 and 2, perspective views of an electrical connector 100 according to the present invention are depicted. The electrical connector 100 includes a base portion 110 and an upper portion 150 as well as components for coupling the two. In particular, one or more electrical leads 105 are secured by one or more lower guides 120 that can be formed on or coupled to a lower surface of the base 110. The leads 105 extend through the base 110 and through intermediate guides 130 formed on the upper base surface opposite the lower base surface. The connector 100 may also include an optional stability post 140 formed on the upper base surface for providing mechanical stability during movement of the connector 100 between a first "open" position, which is shown in FIGS. 1 and 2, and a second "closed" position, which will be explained in greater detail below.

A spring mechanism 135 is also included in the connector 100 for securing the upper portion 150 of the connector 100 to the base 110 while, at the same time, providing resistance between the two components. The spring mechanism 135 preferably includes a post, as shown, that is mechanically secured to the upper portion 150 and to the base 110 and a spring that is fitted around the post and that provides resistance in the direction of movement between the upper portion 150 and the base 110. The post could, for instance, be integrally formed with the upper portion 150 or the base 110, or, alternatively, the post could be manufactured separately and then mechanically fastened to the upper portion 150 and the base 110.

The upper portion 150 of the electrical connector 100 includes a proximal surface in which apertures are formed. The intermediate guides 130 and the optional stability post 140 extend through the apertures and into upper guides 145 formed on the distal surface of the upper portion 150. The upper guides 145 also include guide holes 155 into which the intermediate guides 130 and stability post(s) extend, as mentioned, and through which the electrical leads 105 can extend when the connector 100 is in its closed position.

The electrical connector 100 may be manufactured of any electrically insulative material, such as plastic, with the exception of the electrical leads 105, which should be formed of metal or another electrically conductive material. It will be appreciated that portions, such as the spring, of the connector 100 which are not intended to contact other devices may be formed from any type of material, conductive or insulative. The connector 100 can be fastened to an electronic device (not shown) by securing the base 110 to the device using screws 125 or other fastening elements, such as rivets, adhesives, snap fit mechanisms, etc. When the connector 100 is fastened to an external device, the electrical leads 105 should contact, such as by insertion into holes formed in the external device, electrically conductive terminals from and to which signals are to be transmitted.

When first mechanically and electrically secured to an external device, the connector 100 is in an open position, as shown, in which the upper portion 150 is spaced as far from the base 110 as permitted by the spring mechanism 135. In the open position, the electrical leads 105 are surrounded by the intermediate guides 130 and the upper guides 145 so that no electrical conductive material is exposed through the guide holes 155. In this manner, inadvertent electrical contact can be advantageously prevented.

Figure 3:
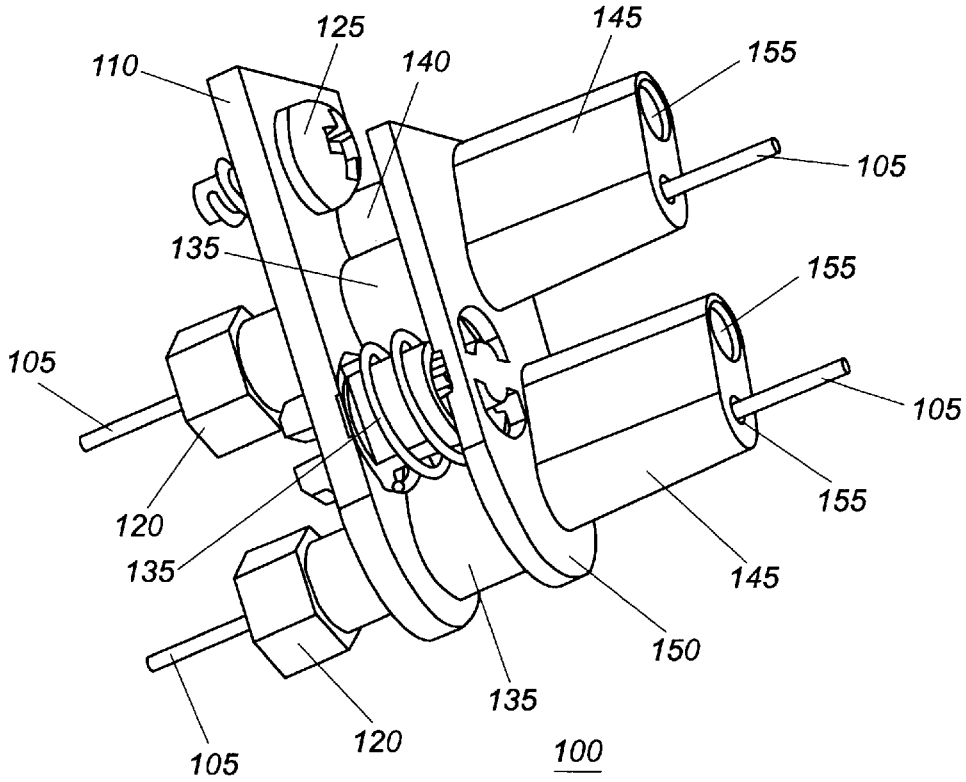
FIGS. 3 and 4 are perspective views of the electrical connector of FIGS. 1 and 2 when the electrical connector is in a second position according to the present invention.
Figure 4:
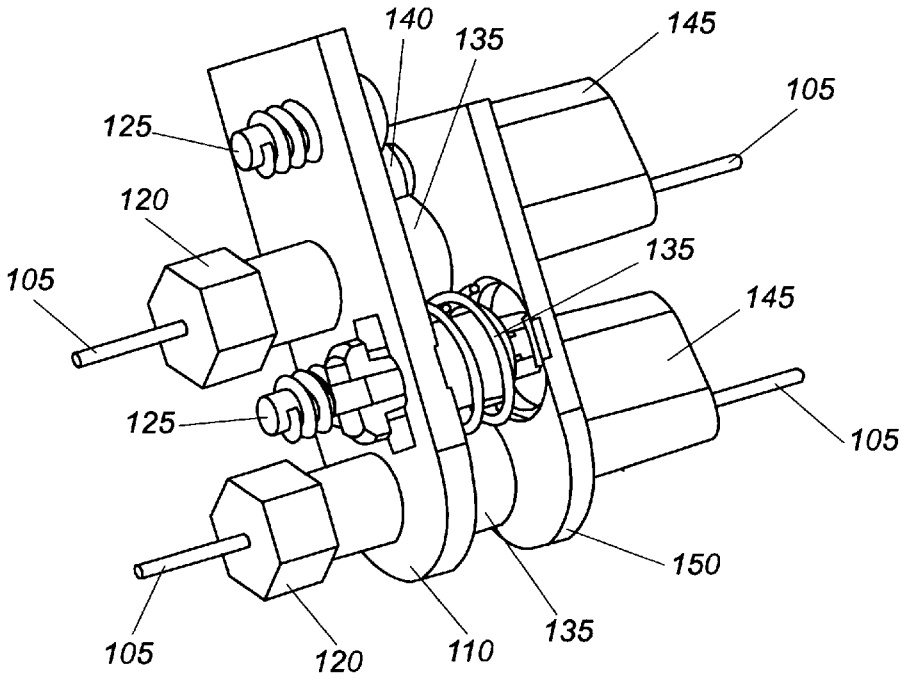

Referring next to FIGS. 3 and 4, the connector 100 is shown in its closed position. The connector 100 is closed by applying pressure to the distal surface of the upper portion 150 so that the upper portion 150 is pushed towards the base portion 110, thereby compressing the spring held between the upper portion 150 and the base 110. In the closed position, the electrical leads 105 (which are longer than the intermediate guides 130) are exposed and extend through the guide holes 155 of the upper guides 145. As a result, when the connector 100 is in its closed position, the electrical leads 105 are able to electrically and mechanically connect a device (not shown) secured to the base 110 to a device (not shown) secured to the upper portion 150.

Figure 5:
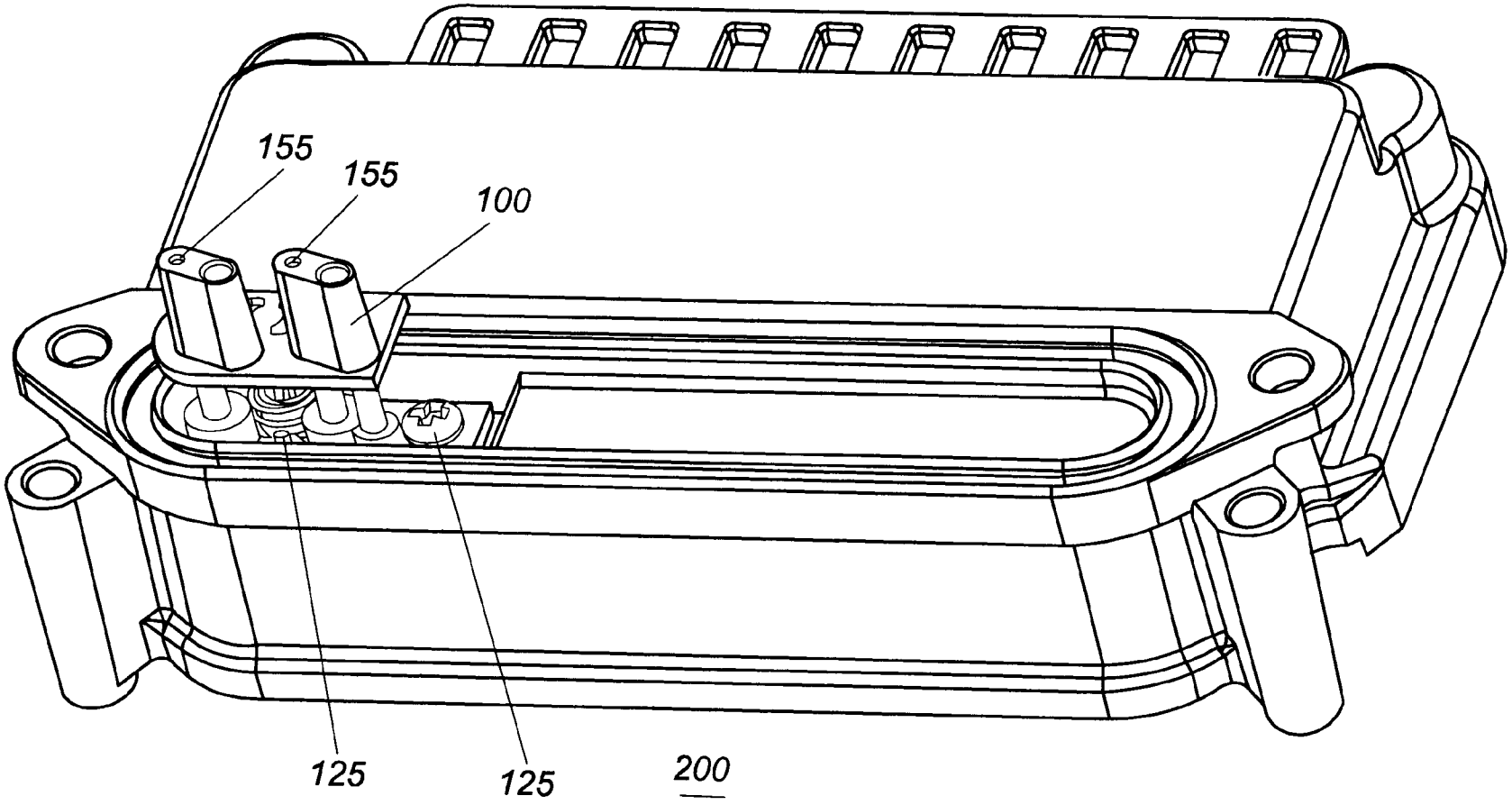
FIGS. 5–7 show a device, such as a cable television tap, to which the electrical connector of FIGS. 1 and 2 can be coupled according to the present invention.
Figure 6:
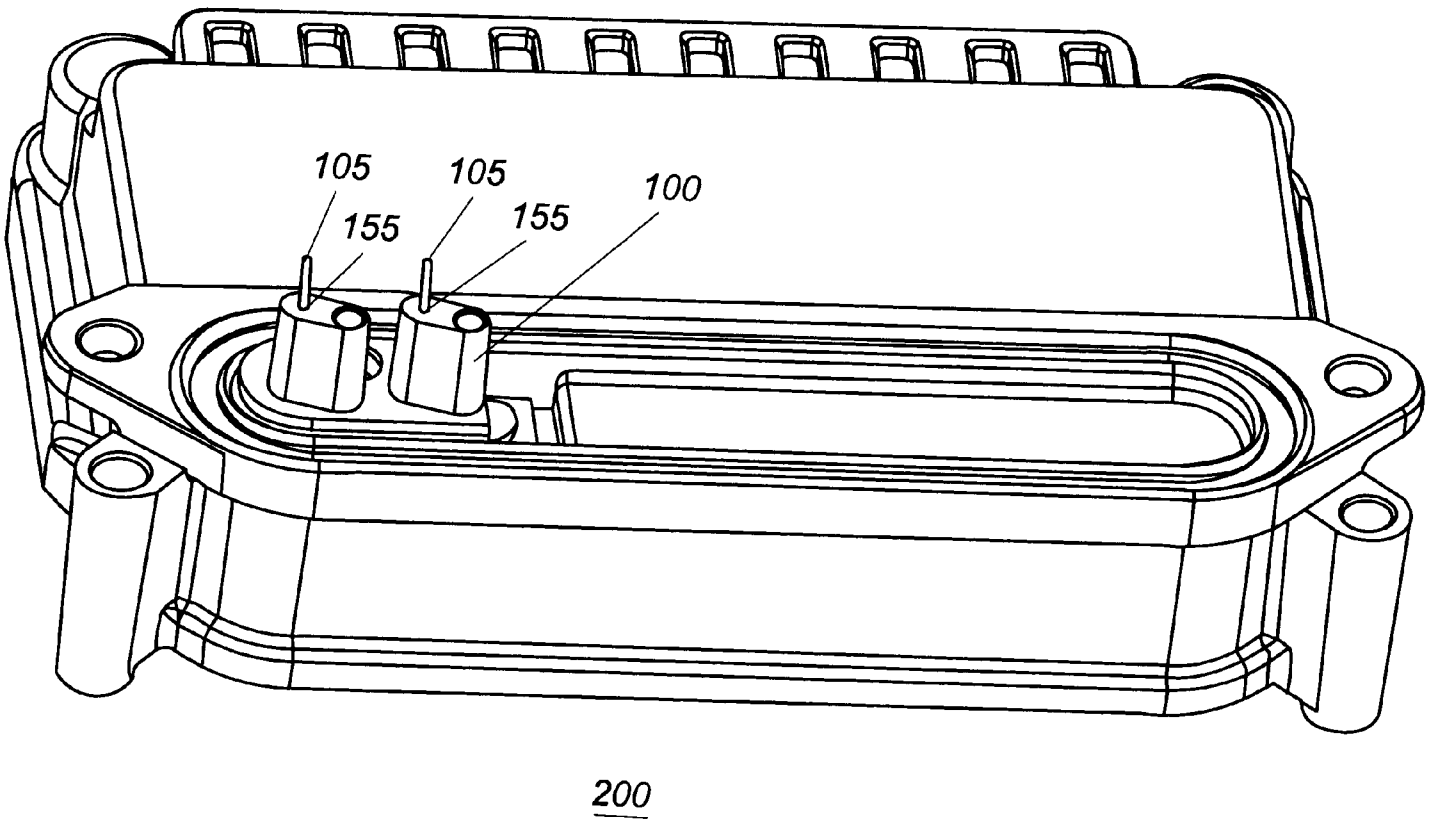
Figure 7:
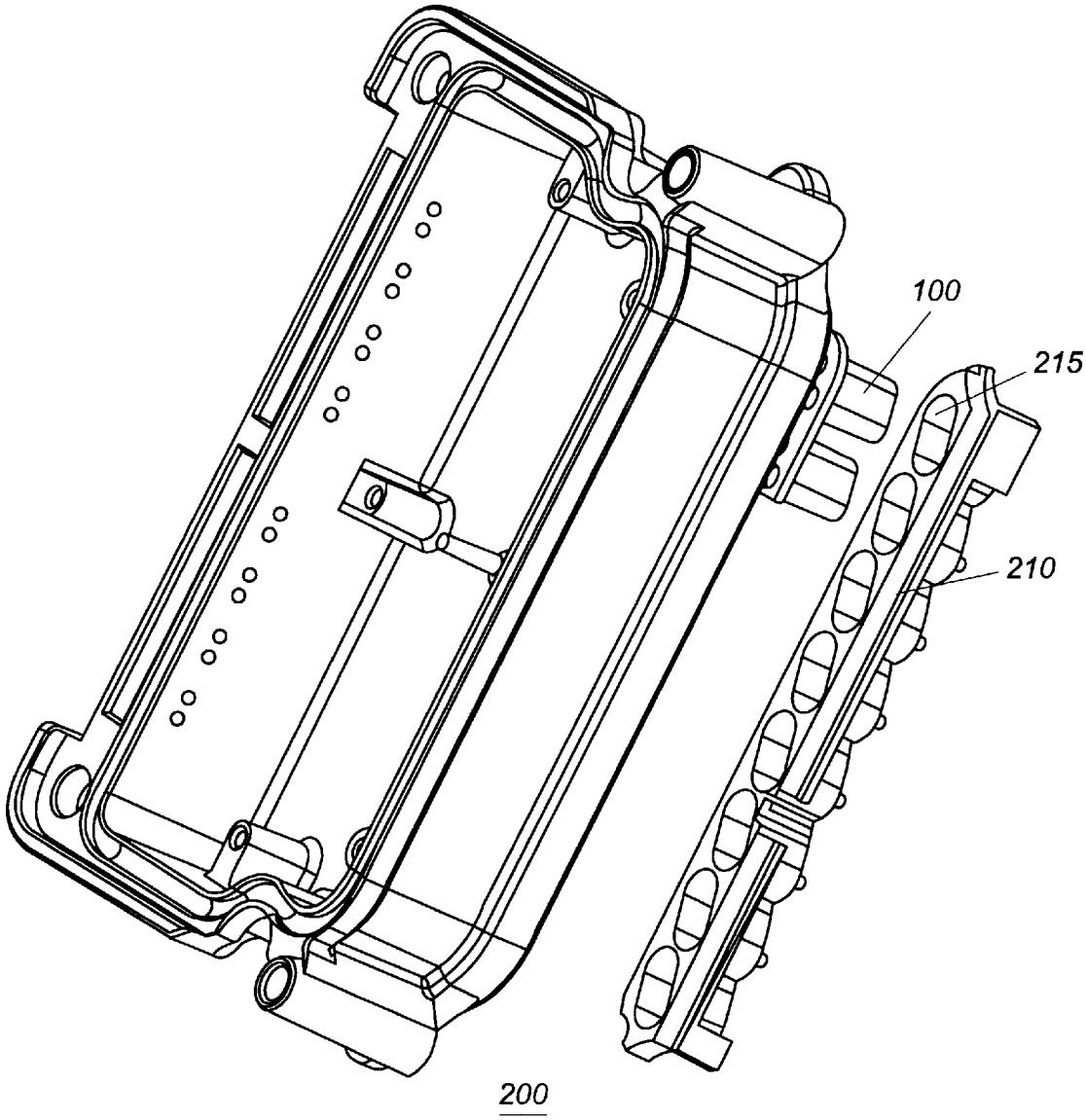

FIGS. 5–7 are illustrations of an external device, such as a tap 200 used in a cable television system or other type of communication system, that can employ the electrical connector 100 of the present invention. FIG. 5 shows the connector 100 in its open position after it has been fastened to the tap 200 by the fasteners 125. In this figure, the base 110 is secured to the tap 200 so that the leads 105 contact desired terminals within the tap 200. The upper portion 150 is held away from the base 110 by the spring mechanism 135 such that the leads 105 do not extend through the upper guide holes 155.

FIG. 6 shows the tap 200 when the connector 100 is in its closed position. As shown, the upper portion 150 has been pushed downwards towards the base 110 so that the leads 105 extend through the guide holes 155, thereby providing a means for electrical coupling to circuitry within the tap 200.

FIG. 7 illustrates a manner in which electrical connection to the circuitry of the tap 200 can be made via the leads 105 of the connector 100. Preferably, a separate device 210 includes mating sockets 215 formed to receive the upper guides 145. When the upper guides 145 are mated with the sockets 215 of the device 210 and the device 210 is pushed towards the tap 200, the connector 100 is pushed into its closed position in which the leads 105 extend through the guide holes 155 to contact circuitry within the device 210. In this way, the leads 105 electrically couple the device 210 to the tap 200.

It will be appreciated that the device 210 could be included as a part of any other device or connection mechanism, and that the device 210 could, when the connector 100 has been pushed into its closed position, be secured to the tap 200 in a manner that holds the connector 100 in the closed position. What is important is that external devices that are to be coupled using the connector 100 have regions that are appropriately formed to contact portions of the leads 105 extending from the lower guides 120 and portions of the leads 105 extending from the upper guides 145.

Advantages of the connector 100 formed in accordance with the present invention are that inadvertent electrical connections are prevented, as described in detail above, that the leads 105 can be automatically mechanically aligned, and that the leads 105, which can be fragile, are protected. More specifically, the use of the formed upper guides 145 provides automatic alignment with appropriate regions of any device in which the mating sockets 215 are formed. When the upper guides 145 are inserted into the mating sockets 215, an action which can be performed easily and with little likelihood of error, the leads 105 are automatically guided into contact with the corresponding terminals of an external device in which the sockets 215 are formed. Reliable, error-free electrical connections can therefore be made so that devices utilizing the connector 100 function properly.

The lower guides 120, intermediate guides 130, and upper guides 145 also cooperate to protect the leads 105, which may be relatively small in diameter and easily broken. The connector base 110 is intended to be fastened to a device, such as the tap 200, in a single assembly procedure so that the connector 100 thereafter remains in place. Another device can be subsequently coupled to and decoupled from the tap 120 a number of times via the connector 100, under which circumstances the leads 105 will only be exposed through the upper guides 145 when the other device has been aligned in a procedure in which the upper guides 145 are properly fitted into corresponding sockets 215. Consequently, the leads 105 only extend through the guide holes 155 once the risks of misalignment and possible lead breakage have been eliminated. Also, as mentioned above, if greater mechanical stability of the connector 100 is required, a stability post 140 can be formed between the upper portion 150 and the base 110 to provide greater mechanical integrity.

It will be appreciated by one of ordinary skill in the art that the connector 100 can have any number of electrical leads 105 that can be connected to an external device in any desired manner. The leads 105 could, for example, be designed in such a way as to eliminate the need for the lower guides 120 altogether, such as when the leads 105 extend only a short distance beneath the lower surface of the base 110. Furthermore, the connector components, such as the upper guides 145, could be shaped differently as long as sockets 215 formed to mate with the guides 145 provide the appropriate alignment functions.

In summary, the connector as described above includes a base portion and an upper portion that surround and protect electrical leads when the connector is in an open, or electrically decoupled, position, thereby preventing unintentional electrical connections and lead breakage. The base and upper portions are formed to automatically guide the electrical leads into proper alignment with another device to further minimize the likelihood of lead breakage and to reliably interconnect external electronic devices.

What is claimed is:

1. A connector, comprising:

an electrical lead;

a base through which the electrical lead extends;

an upper portion through which the electrical lead extends, the upper portion formed in a plane substantially parallel to that of the base, and the upper portion including an upper guide having a hole formed therein;

an intermediate guide for surrounding a portion of the electrical lead that is located between the upper portion and the base; and a spring mechanism including a spring for mechanically coupling the base and the upper portion and for holding the base away from the upper portion, wherein:

the spring can be compressed between the base and the upper portion in a direction substantially perpendicular to the planes in which the base and the upper portion are formed;

when the connector is in an open position, the spring holds the upper portion a maximum distance from the base, and the electrical lead does not extend through the hole in the upper guide; and when the connector is in a closed position, the spring is compressed, the upper portion is a minimum distance from the base, and the electrical lead extends through the hole in the upper guide.

2. The connector of claim 1, wherein:

the electrical lead is electrically conductive.

3. The connector of claim 1, wherein the upper portion and the base are electrically insulative.

4. The connector of claim 1, further comprising:

a fastener for mechanically securing the base to an external device.

5. The connector of claim 1, wherein, when the spring is compressed and the connector is in a closed position, the upper portion and the upper guide slide over the intermediate guide to expose a portion of the electrical lead.

6. An electrical device for connecting to another device, the electrical device comprising:

circuitry for processing electrical signals; and a connector for coupling the electrical signals to the other device, the connector comprising:

an electrical lead that connects at a first end to the circuitry;

a base through which the electrical lead extends;

an upper portion through which the electrical lead extends, the upper portion including an upper guide having a hole formed therein, and the upper portion formed in a plane substantially parallel to that of the base;

an intermediate guide for surrounding a portion of the electrical lead that is located between the upper portion and the base; and a spring mechanism including a spring for mechanically coupling the base and the upper portion and for holding the base away from the upper portion, wherein:

the spring can be compressed between the base and the upper portion in a direction substantially perpendicular to the planes in which the base and the upper portion are formed;

when the connector is in an open position, the spring holds the upper portion a maximum distance from the base, and the electrical lead does not extend through the hole in the upper guide, thereby electrically decoupling the electrical device from the other device; and when the connector is in a closed position, the spring is compressed, the upper portion is a minimum distance from the base, and the electrical lead extends through the hole in the upper guide, thereby electrically coupling the electrical device to the other device.

7. The electrical device of claim 6, wherein:

the electrical lead of the connector is electrically conductive.

8. The electrical device of claim 6, wherein the upper portion and the base of the connector are electrically insulative.

9. The electrical device of claim 6, wherein the connector further comprises:

a fastener for mechanically securing the base to the electrical device.

10. The electrical device of claim 6, wherein, when the spring of the connector is compressed and the connector is in a closed position, the upper portion and the upper guide slide over the intermediate guide to expose a portion of the electrical lead so that it contacts a circuit within the other device.

* * * * *